US006263766B1

(12) United States Patent
Jarvis

(10) Patent No.: US 6,263,766 B1
(45) Date of Patent: Jul. 24, 2001

(54) PALM RATCHET HAVING RELEASABLY ATTACHED LATERAL HANDLE

(76) Inventor: Jack D. Jarvis, 3204 Periwinkle, Memphis, TN (US) 38127

( * ) Notice: Subject to any disclaimer, the term of this patent is extended or adjusted under 35 U.S.C. 154(b) by 620 days.

(21) Appl. No.: 08/876,191

(22) Filed: Jun. 13, 1997

Related U.S. Application Data

(63) Continuation of application No. 08/586,605, filed on Jan. 16, 1996.

(51) Int. Cl.[7] ..... B25B 13/46
(52) U.S. Cl. ..... 81/60; 81/177.2; 81/177.85
(58) Field of Search ..... 81/60–63.2, 117.2, 81/177.7, 177.85

(56) References Cited

U.S. PATENT DOCUMENTS 1,371,350 * 3/1921 Campbell ..... 81/63.2
2,891,434 * 6/1959 Lozensky ..... 81/63 X
4,480,511 11/1984 Nickipuck .
4,748,874 * 6/1988 Sharp et al. ..... 81/177.2 X
4,768,405 9/1988 Nickipuck .
4,791,837 * 12/1988 Main ..... 81/63.1
4,905,549 * 3/1990 Nickipuck ..... 81/177.85
4,938,107 7/1990 Nickipuck .

* cited by examiner

*Primary Examiner*—James G. Smith
(74) *Attorney, Agent, or Firm*—Paul M. Denk

(57) ABSTRACT

A socket wrench assembly having a drive handle and interchangeable, varible-sized socket drive heads. The drive heads have a round, flat configuration. A conventional rotatable square drive extends from one side and is operatively connected to an internal ratcheting mechansim. The drive head has a square bore formed in the edge. The handle has a spring biased locking mechanism to releasably secure the handle in the bore. The drive head can function as a palm ratchet without the handle attached.

7 Claims, 3 Drawing Sheets

46

46

31
31

31

45
42

42
44
43

3
52

25

25
23
22
21
19
27
30
47
48
49

23
25
22
21
19
30

52
3
50
51

33
37
34

33
34
36
37

33
34
36
37
40

51
50
3

25
22
19

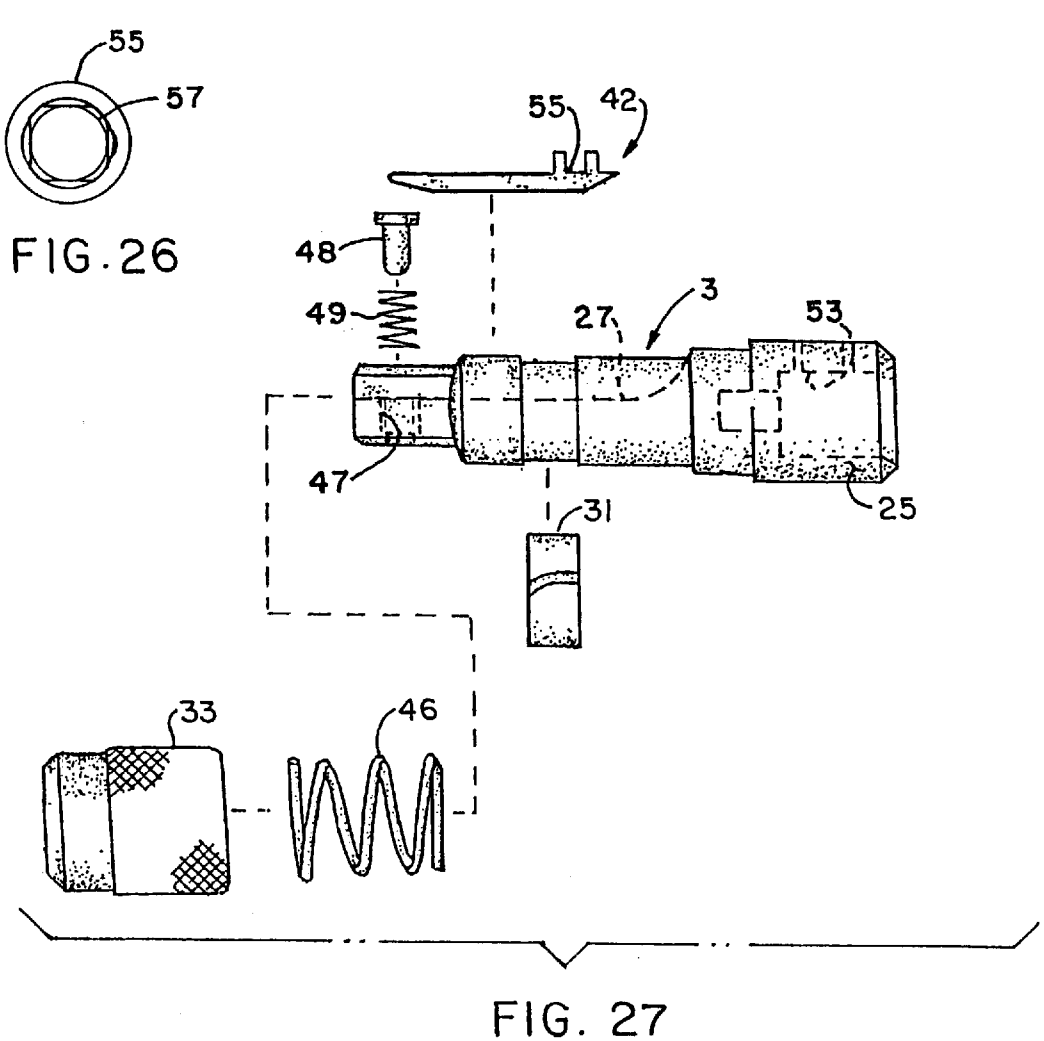
FIG. 27
FIG. 26
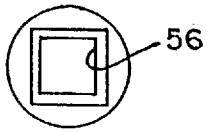
FIG. 25
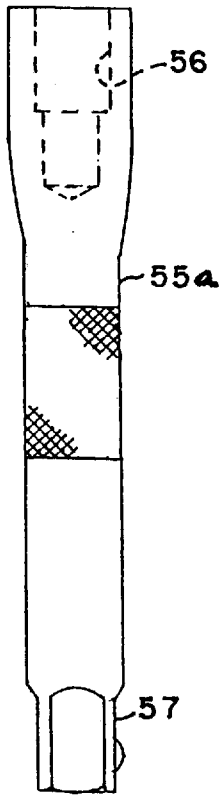
FIG. 24
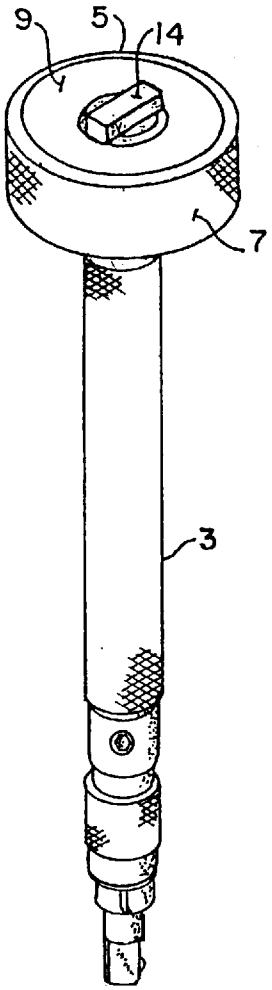
FIG. 23

PALM RATCHET HAVING RELEASABLY ATTACHED LATERAL HANDLE

CROSS REFERENCE TO RELATED APPLICATION

This application is designated as a continuation of the application of the same inventor, having Ser. No. 08/586,605, filed on Jan. 16, 1996, said applications being owned by a common inventor.

BACKGROUND OF THE INVENTION

This invention relates generally to hand tools and more specify to a socket wrench assembly having a drive handle with a side-attached, removable, interchangeable socket drive head that also functions as a palm ratchet.

Socket wrenches are known to the art. Generally, a socket wrench set has a number of interchangeable sockets that can be attached to a socket drive head which is integrally connected to a drive handle. The sockets are cylindrical in shape and have a square opening at one end for attachment to the socket drive head, and a round, internally faceted, work-piece engaging orifice at the other end. Typically, the work-piece is a nut or bolt. The sizes of the work-piece engaging orifices differ amount the various interchangeable sockets so that the user can change sockets depending upon the size of nut or bolt. For example, the socket can range from ¼ inch to one inch or more.

As stated above, the socket drive head generally is integrally connected to the handle. The socket drive head has a rotatable square drive extending from one side. Within the head is a conventional ratcheting mechanism. The ratcheting mechanism is adjustable by an external button or lever so that the ratcheting mechanism allows the square drive to rotate in opposite directions, for tightening or loosening a workpiece. Since the socket drive head is integral to the handle, usually as forged metal, the handle cannot accommodate different sizes of socket drive heads having different sizes of square drives. It will be appreciated that larger or heavier square drives are desirable when using a larger socket. Therefore, it would be useful to have a handle with interchangeable drive heads having various sized square drives.

Another style of socket drive head is the palm ratchet. The palm ratchet is a round drive head sans the handle. The palm ratchet has a conventional square drive and internal ratcheting mechanism and can be held in the palm of the hand or fingers and rotated. Palm ratchets are useful in certain applications. However, the palm ratchet would be more versatile if it could be connected to a handle, if desired.

It would be advantageous, therefore, to have a handle and interchangeable socket drive heads wherein the drive head is comprised of interchangeable, variable sized palm ratchets so that one handle can be used with different sized palm ratchets functioning as the drive head. Thus, the user could have two sets of wrenches in one. One set would be a handled set with interchangeable drive heads and the other set would be comprised of the various sized palm ratchets.

SUMMARY OF THE INVENTION

It is among the principal objects of the present invention to provide a socket wrench drive handle having interchangeable socket drive heads.

Another object of the invention is to provide such a set of sockets wherein the interchangeable drive heads also function as palm ratchets without the handle.

It is another object of the present invention to provide such a socket wrench drive handle and interchangeable socket drive heads wherein the palm ratchets are round and have a flat configuration with an opening in the edge for the releaseable attachment of the drive handle.

Still another object of the invention is to provide such a socket wrench drive handle and interchangeable palm ratchet drive heads wherein the handle has a spring biased mechanism for engaging the opening in the edge of the socket drive head.

In accordance with the invention, generally stated, a socket wrench drive handle and interchangeable, variable-sized, removable socket drive heads assembly is provided. The drive heads have a round, flat configuration. A conventional rotatable square drive extends out of one flat side of the drive head. The square drive is operatively connected to a conventional ratcheting mechanism. The drive head has a substantially square bore formed in the edge. The drive handle has a locking mechanism on one end to releasably secure the handle in the square bore. The drive heads can function without the handle attached as palm ratchets.

BRIEF DESCRIPTION OF THE DRAWINGS

FIG. 23 discloses the drive head 5 having the drive handle 3 connecting with its drive;

FIG. 24 is a side view of a modified handle of the type for connection with the drive head drive;

FIG. 25 is a top end view thereof;

FIG. 26 is a bottom end view thereof; and

FIG. 27 is an exploded view of the socket wrench handle, showing greater detail of the various components as assembled into the drive handle shown in FIG. 5.

DESCRIPTION OF THE PREFERRED EMBODIMENT

Figure 1:
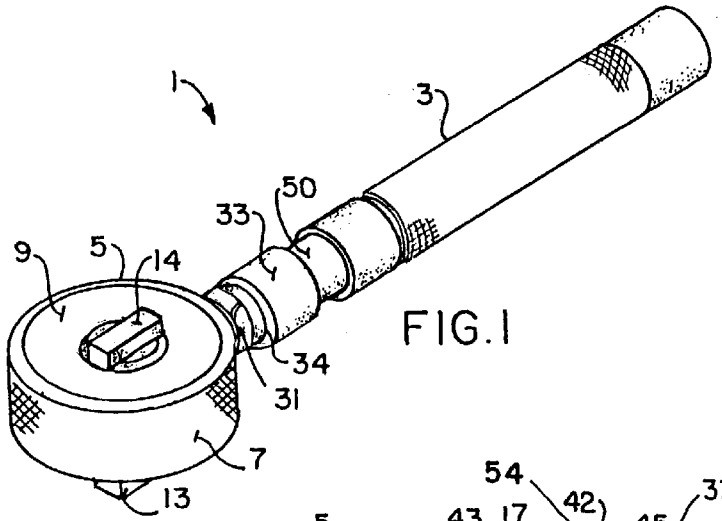
FIG. 1 is an isometric view of the socket wrench drive handle and drive head assembly of the present invention.
Figure 2:
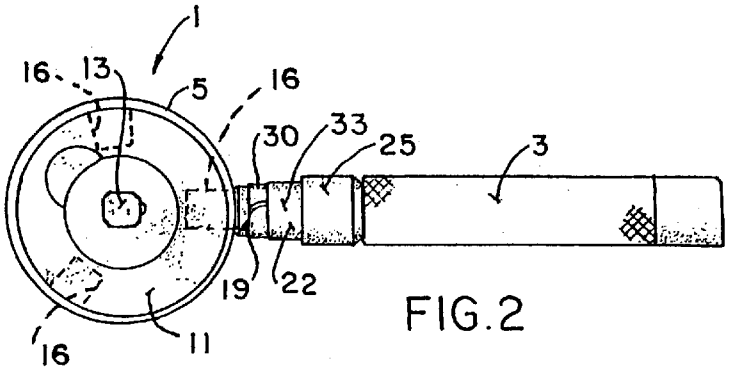
FIG. 2 is a bottom plan view thereof.

A socket wrench handle and drive head assembly of the present invention is indicated generally by reference numeral 1 in the drawings. Wrench assembly 1 contains a drive handle 3 and a removable drive head 5. It will be appreciated that the handle and the drive 5 can be provided in various sizes to accommodate various sizes of sockets without departing from the scope of the invention. The elements of wrench assembly 1 will now be described in greater detail.

Drive head 5 has a circumferential side wall 7, a top wall 9 and a bottom wall 11.

There is a conventional square drive 13 extending out of bottom wall 11. It will be understood that the square drive, which is conventional having a spring-biased detent ball, can be of any appropriate dimension so as to engage a socket of an appropriate size. For example, square drive 13 can be a ¼ inch drive or a ½ inch drive or so on. The drive 13 has a conventional spring-biased detent ball BA. The protruding square drive is connected to an internal ratcheting mechanism (not shown) within head 5. The ratcheting mechanism is conventional and allows the square drive to be locked in place so that it rotates only in a first direction to allow convenient tightening of a work piece or locked to rotate in a second direction for loosening of a work piece. There is a knob 14 on the top wall. Knob 14 is operatively connected to the internal ratcheting mechanism and can be rotated to effect the appropriate locking of the ratcheting mechanism.

There is a substantially square bore 16 in side wall 7 for the insertion of handle 3 as will now be explained. Three such bores may he provided around the perimeter of the side wall of the drive head 5.

Figure 5:
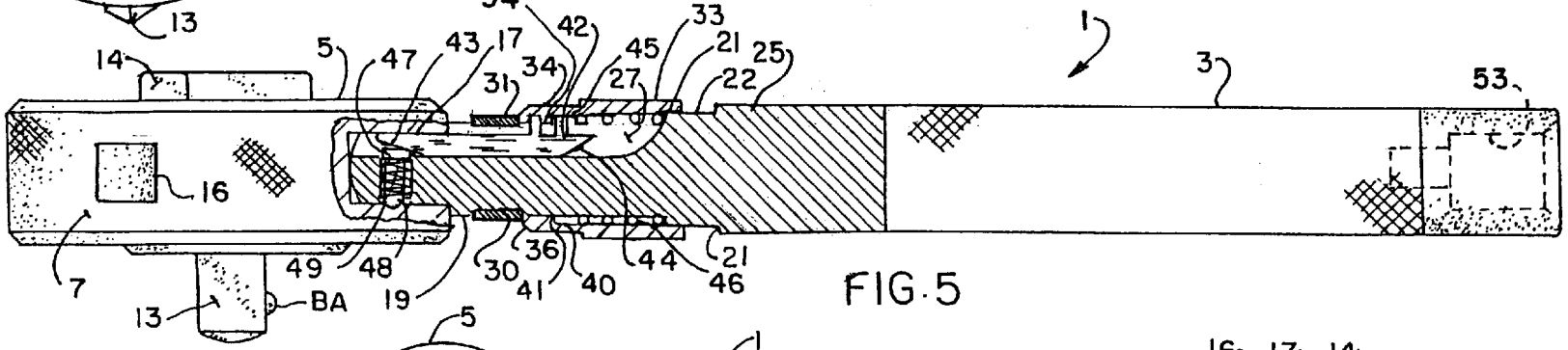
FIG. 5 is a side elevational view, partially cut away, of the socket wrench handle and drive head assembly of the present invention.
Figure 4:
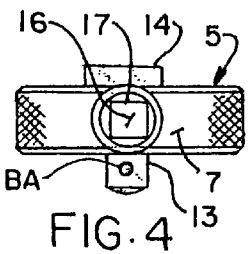
FIG. 4 is a side elevational view of an interchangeable drive head element of the socket wrench handle and drive assembly, showing the handle attachment opening formed therein.
Figure 3:
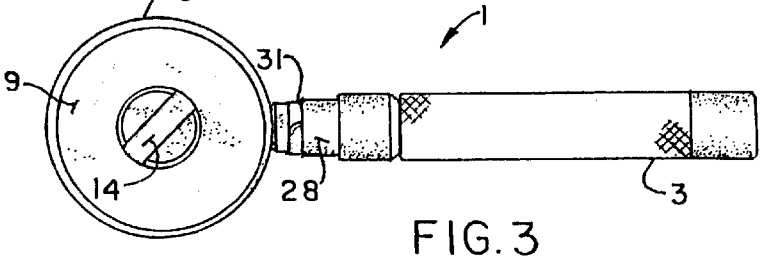
FIG. 3 is a top plan view thereof.

As best seen in FIGS. 4 and 5, bore 16 has a plurality of faces 17 which engage the locking end mechanism of the handle. The locking mechanism of the handle, and as best seen in FIGS. 5–17, has a shank 19 which terminates at one end with shoulder 21. There is a collar 22 adjacent the shoulder and a second collar 25. Collars 22 and 25 have an internal bore 23, for the insertion of the handle 3, as will be explained below. A slot or channel 27 is formed in the surface of the shank and extends the length of the shank. Shank 19 has an external annular groove 30. (A spring lock ring 31)is seated in groove 30. There is a slidable sleeve 33 around the shank. The outer surface of sleeve 33 can be covered with a friction increasing pattern such as knurling. Sleeve 33 has an concentric portion 34 which terminates in a beveled end 36. (End 36 has a tip 37 that extends towards groove 30 and abuts spring 31). There is an internal bore 40 within the sleeve that extends into concentric portion 34. Bore 40 is smaller at tip 37 creating a shoulder 41.

Figures 6, 7, 8, 9, 10, 11, 12, 13, 14, 15, 16, 17, 18, 19, 20, 21, 22:
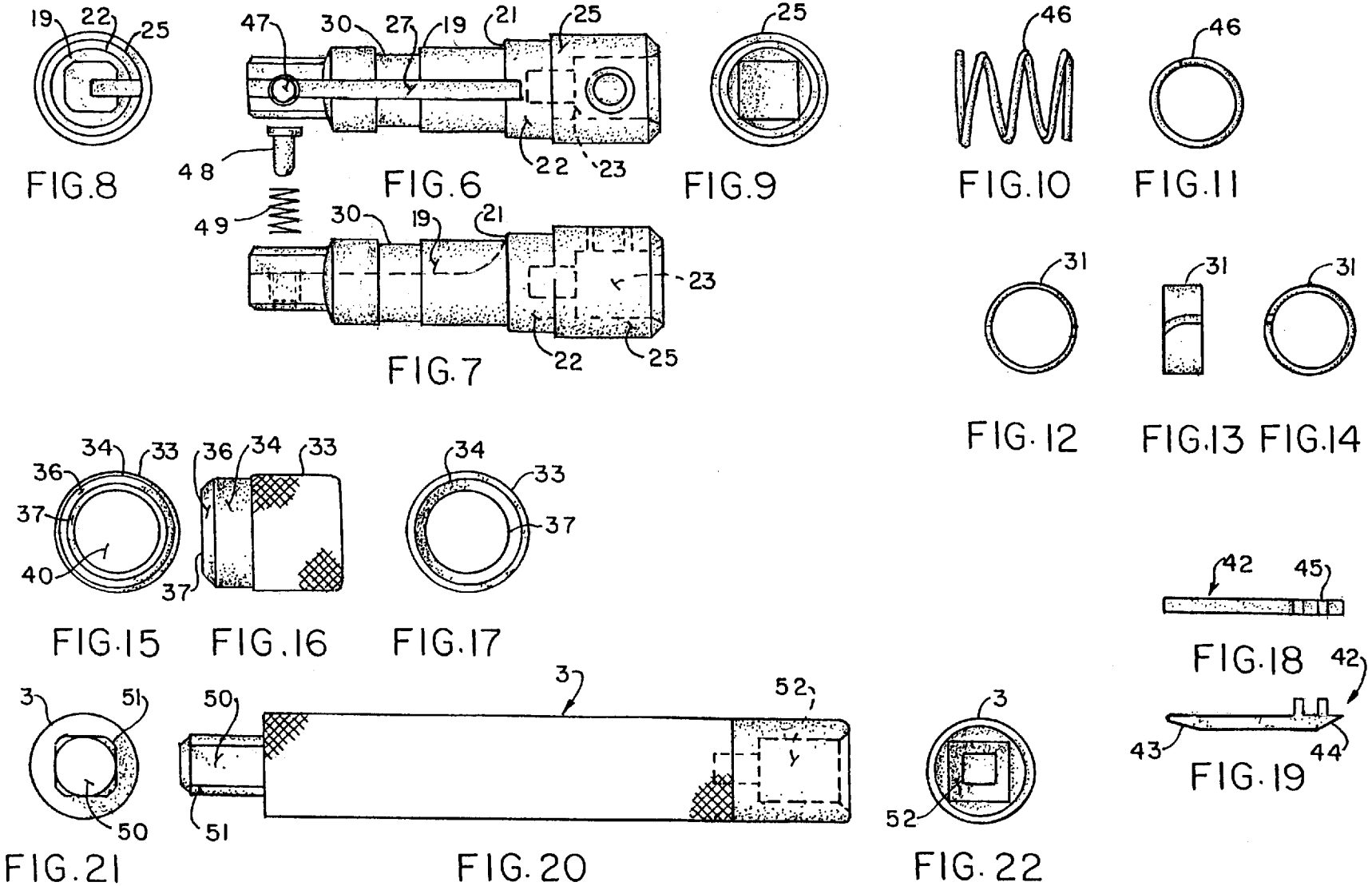
FIG. 6 is a top plan of the locking mechanism shank.
FIG. 7 is a side view thereof.
FIG. 8 is an end plan thereof.
FIG. 9 is an end plan of the opposte end thereof.
FIG. 10 is a side plan of the coil spring.
FIG. 11 is an end plan thereof.
FIG. 12 is an end plan of another coil spring.
FIG. 13 is a side elevational view thereof.
FIG. 14 is another end plan thereof.
FIG. 15 is an end plan of the locking mechanism sleeve.
FIG. 16 is a side elevational view thereof.
FIG. 17 is another end plan thereof.
FIG. 18 is a top plan of the control bar.
FIG. 19 is a side elevational view thereof.
FIG. 20 is a side elevational view of the handle.
FIG. 21 is an end plan thereof.
FIG. 22 is another end plan thereof.

A control bar 42 is carried in channel 27. As shown in FIGS. 18 and 19, control bar 42 has an upwardly ramped tip 43 and an upwardly ramped rear end 44. A raised portion or spur 45 extends outward from the control bar extends into bore 40 and abuts shoulder 41. There is a coil spring 46 around the shank and positioned between spur 42 and the shoulders 25 and 41. As will be appreciated, sleeve 33 can move back and forth on shank 19. The forward movement is stopped when the tip 37 engages the spring and cannot be moved any further forward. The rearward movement is stopped when the control bar abuts the rear of channel 27.

There is a transverse bore 47 in channel 27 in which a retainer ball 48 is carried. The control bar 42 remains forward enough so that the tip of the bar is always over the bore. There is a coil spring 49 between the tip of the bar and ball 48. Spring 46 urges the sleeve 33 forward moves urges the bar and sleeve 33 forward. Spring 49 urges ball 48 normally upwardly, but the control bar 42 urges the ball 48 against its spring to engage the inside of bore 16, and into its located dimple, to hold the handle in place. See FIG. 5. When the user slides sleeve 33 backward, it pulls the bar 42 back in the channel. The end of bar 42 raises due to the camming action of the rear end 44 under the upward pressure from spring 49 can move upward against ramp relieving some of the downward press on ball 48. This allows the ball to recede out of the dimple. The handle then is easily withdrawn from bore 16.

Handle 3 is attached to the locking mechanism. As best seen in FIGS. 20–22, handle 3 has a foward, concentric extension 50 sized to engage bore 23. Extension 50 is generally square in cross section and has rounded corners 51. There is a threaded transverse bore 52 in communication with bore 23. A threaded set screw 54 is placed in the bore and holds the handle in place. There is a substantially square bore 52 formed in the opposite end of handle 3. Bore 52 can accommodate the insertion of another handle 3 or other extension means to expand the handle into a longer handle.

FIG. 27 discloses greater detail, showing the component assembly, of the drive handle 3 of this invention. As disclosed, it can be seen that the drive handle, in this particular instance, is of a more shortened configuration, and has a socket, as at 53, provided at its back end. Other tools may be inserted therein, such as a horizontally disposed drive bar, or the like, for use for providing leverage when utilizing the drive handle and drive head of this invention. A similar type of socket arrangement is shown at 53A, in FIG. 5. The retainer ball or stem 48, along with its spring 49, fits into its corresponding transverse bore 47. The control bar 42 fits within its previously defined slot, 27, and is held in position, and urged forwardly, by means of the interengagement between the sleeve 33, and its spring 46, assembled upon the drive handle as previously explained. The spring sleeve 31 holds these components into their assembled position, by means of the integral tab 54 of the sleeve 33 inserting into the groove 55 of the said bar 42. Thus, as previously explained, when the bar 42 is urged forwardly, by means of the biasing spring 46, it pushes its bar 48 laterally, with respect to the drive handle 3, and forces its tip, against the urging of its associated spring 49, transversely, extending out of the handle, and biasing against the surface of any bore 16, into which the handle has been inserted. As previously explained, a pull back of the sleeve 33 releases the lateral bar 48, and allows the handle to be disengaged from any tool, such as the drive head 5, or other tool component.

FIG. 23 discloses how a drive handle 3, of the type as either explained in FIGS. 5, or 27, may secure by means of their sockets 53 or 53A, to the drive 13 of a drive or ratchet head 5, and used as a palm ratchet for driving other components, into either a tightened or loosening configuration.

FIGS. 24 through 26 disclose how a socket tool, formed as a handle, such as shown at 55*a*, may be fabricated with a socket at its upper end, as at 56, have the type as previously explained and defined in copending application having Ser. No. 08/398,691, the subject matter of which is incorporated herein by reference. The bottom end of the handle 55*a* may include a male socket, as at 57, and which may be useful for engaging onto the tool or other component to be turned, after a palm ratchet, of the type as shown at 5, may be engaged into the upper end socket 56, in preparation for its being forcefully turned during usage and application.

It will be appreciated that the socket wrench assembly just described may be modified without departing from the scope of the appended claims. Therefore, the foregoing description and accompanying drawings are intended to be illustrative and should not be construed in a limiting sense.

What is claimed is:

1. A socket wrench and handle assembly comprising:

an elongated handle, said elongated handle having a socket formed at its back end;

a socket drive head, said socket drive head comprising a palm ratchet, said palm ratchet having a round configuration formed with a sidewall, and having upper and lower flat walls formed thereof, at least one bore formed in said side wall thereof, said palm ratchet also having a drive extending out of its lower flat wall;

said handle capable of being removably attached within said at least one bore of the palm ratchet, and when attached, said handle having one end engaged in said bore; said handle having a locking mechanism at its bore engaging end;

said locking mechanism having a shank, a sleeve slidingly engaged longitudinally coaxial around the shank, a channel formed in the shank, a spring bias control bar shiftably arranged in the shank channel, said bar having a pair of ribs extending radially therefrom, and forming a groove intermediate thereof, said sleeve having an integral tab extending thereof, and arranged within the bar ribs formed groove, whereby upon axial shifting of the sleeve upon the shank the bar slides therewith, said shank having a groove formed thereon forwardly of said arranged sleeve, and a spring lock ring fitted within said shank groove and disposed for encountering the front of said sleeve to limit the forward movement of said sleeve upon the shank, said spring lock ring always being exposed forwardly of said associated sleeve;

the locking mechanism further including a spring biased detent means arranged within a transverse bore formed approximate the front end of said handle, said detent means comprising a spring biased singular stem, transversely arranged within the transverse bore, said stem having an enlarged head, said stem head always being urged into and remaining always in contact with said control bar by the bias of said spring, and said stem being biased by said control bar into its locking engagement within the bore of the palm ratchet when assembled;

whereby said elongated handle capable of attaching through its locking mechanism within at least one bore formed in the side of said palm ratchet or said elongated handle may connect by its back end formed socket to the drive extending from the lower flat wall of said palm ratchet.

2. The socket wrench of claim 1 wherein said handle is expandable.

3. The socket wrench of claim 1 wherein said palm ratchet having a series of bores spacedly formed therein within its side wall around its perimeter.

4. The socket wrench of claim 3 wherein there are three bores formed within the palm ratchet.

5. The socket wrench of claim 1 wherein the drive of the palm ratchet includes a downwardly extending centrally arranged drive, and the elongated handle having said socket at its back end, and said socket being engaged by the palm ratchet drive.

6. The socket wrench of claim 1 wherein said control bar urging said detent means into engagement within the palm ratchet bore to prevent disengagement of the palm ratchet from the elongated handle during application.

7. The socket wrench of claim 1 wherein said wrench handle having said formed socket at its back end thereof, for accommodating the insertion of another tool.

* * * * *